US008777076B1

(12) United States Patent
Carrier

(10) Patent No.: US 8,777,076 B1
(45) Date of Patent: Jul. 15, 2014

(54) MULTIFUNCTIONAL ORGANIZER AND METHOD OF MAKING

(76) Inventor: Ann Marie Carrier, Ridgefield, NJ (US)

( * ) Notice: Subject to any disclaimer, the term of this patent is extended or adjusted under 35 U.S.C. 154(b) by 145 days.

(21) Appl. No.: 13/303,151

(22) Filed: Nov. 23, 2011

Related U.S. Application Data

(60) Provisional application No. 61/458,489, filed on Nov. 24, 2010.

(51) Int. Cl.
*B65D 30/22* (2006.01)

(52) U.S. Cl.
USPC ..... 224/577; 383/4; 383/39; 150/106; 224/578

(58) Field of Classification Search
USPC ..... 224/577, 575, 42.11, 578, 155, 153, 224/600, 683, 682, 684; 150/106, 111, 128, 150/129; 383/2, 4, 37, 39, 40, 16, 117, 120
See application file for complete search history.

(56) References Cited

U.S. PATENT DOCUMENTS

| | | | | |
|---|---|---|---|---|
| 3,187,903 | A * | 6/1965 | Oltz | 211/88.01 |
| 4,468,810 | A * | 8/1984 | Longo | 383/3 |
| 4,674,664 | A * | 6/1987 | Simon | 224/604 |
| 5,139,187 | A * | 8/1992 | Fowler | 224/576 |
| 5,178,310 | A * | 1/1993 | Sowerby | 224/153 |
| 5,620,229 | A * | 4/1997 | Ledford | 297/229 |
| 5,938,336 | A * | 8/1999 | King | 383/4 |
| 8,016,484 | B1 * | 9/2011 | Cross | 383/4 |
| 2005/0053312 | A1 * | 3/2005 | Hankins et al. | 383/4 |
| 2005/0236450 | A1 * | 10/2005 | Iannini | 224/577 |
| 2007/0122066 | A1 * | 5/2007 | Landay | 383/16 |
| 2008/0252115 | A1 * | 10/2008 | Machabee | 297/217.1 |

FOREIGN PATENT DOCUMENTS

| | | | |
|---|---|---|---|
| GB | 2274582 | A * | 8/1994 |
| JP | 2004074698 | A * | 3/2004 |

* cited by examiner

*Primary Examiner* — Justin Larson
*Assistant Examiner* — Phillip Schmidt
(74) *Attorney, Agent, or Firm* — Invention To Patent Services; Alex R Hobson

(57) ABSTRACT

A multipurpose organizer that can be quickly and easily converted into multiple articles such as but not limited to a carrying tote, a purse, a seat organizer and a head rest is provided. The method of making the multifunctional organizer and the methods of using the multifunctional organizer are also provided. In one embodiment the main body of consists of a single piece of material providing for low cost construction.

13 Claims, 13 Drawing Sheets

MULTIFUNCTIONAL ORGANIZER AND METHOD OF MAKING

CROSS REFERENCE TO RELATED APPLICATIONS

The present invention claims priority to U.S. Provisional patent application No. 61/458,489 filed on Nov. 24, 2010 and entitled MULTIFUNCTIONAL ORGANIZER AND METHOD OF MAKING, which is incorporated herein by reference in its entirety.

FIELD OF THE INVENTION

The present invention relates to multipurpose organizers that can be converted into multiple articles such as but not limited to a carrying tote, a purse, a seat organizer, and a head rest, the method of making the multifunctional organizer and the methods of using the multifunctional organizer.

BACKGROUND OF THE INVENTION

Carrying totes are a convenient way to transport and organize items, including personal items, clothing and in some cases a towel or pillow. In some cases a large carrying tote may be desired for transporting items and in other cases a smaller tote or purse may be desired. When traveling to the beach or pool, and sitting down to relax, it is desirable to have quick and convenient access to personal items contained with a carrying tote. It is also desirable to keep a carrying tote off of the ground or out of the sand where it can become soiled or covered with sand, dirt or water. It is also desirable in some cases to have a head rest when relaxing in a chair and in particular a lounge chair.

SUMMARY OF THE INVENTION

The invention provides a multifunctional organizer that in one embodiment is convertible to a carrying tote, a purse, a seat organizer, and a head rest. In one embodiment the multifunctional organizer comprises a main body consisting of a single contiguous piece of rectangular shaped material, wherein the main body comprises a center portion having a length and width, a pair of opposing longitudinal edges, a pair of opposing lateral edges, a first pocket portion and a second pocket portion, wherein each pocket portion comprising at least three accordion folds, wherein at least two pockets are formed from folded to sections of the main body material. In addition, in one embodiment the multifunctional organizer also comprises attachments along the edges of the accordion folds on both the first and second pocket portions, and at least one dividing attachment along at least the length of the outer accordion fold between the two longitudinal edges of the accordion fold; at least two fasteners positioned across the width of the main body between the center portion and both the first pocket portion and the second body portion; and a carrying strap having a length and two ends that are attached to at least two of the fasteners. In addition, the invention provides for other embodiments having variations and combination of elements herein described.

The invention provides methods of using the multifunctional organizer in many different ways including but not limited to, as a carrying tote, a purse, a seat organizer, and a head rest.

The invention provides a quick and easy way to make the multifunctional organizer, including but not limited to, making accordion folds in a single contiguous piece of material and incorporating attachments along the longitudinal edges of the accordion folds on both the first and second pocket portions, positioning and attaching at least two fasteners across the width of the main body between the center portion and both the first pocket portion and the second body portion; and in some embodiment, attaching a carrying strap having a length and two ends, to at least two of the fasteners.

BRIEF DESCRIPTION OF THE FIGURES

Corresponding reference characters indicate corresponding parts throughout the several views of the figures. The figures represent an illustration of some of the embodiments of the present invention and are not to be construed as limiting the scope of the invention in any manner.

DETAILED DESCRIPTION OF ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

The multifunctional organizer of the present invention can be converted into a number of different useful articles including but not limited to a carrying tote, a purse, a seat organizer and a head rest. The versatile design of the multifunctional organizer allows it to be quickly converted from one form to another. In addition, the design of the multifunctional organizer, having a main body consisting of a single contiguous piece of material, provides for the quick, simple and low cost manufacture of the multifunctional organizer.

The versatility of the multifunctional organizer makes it ideal for travel to and from the beach or pool, where it can be easily converted from a carrying tote or purse to a seat organizer providing convenient organization of personal items that are readily in reach. In addition, in one embodiment with the multifunctional organizer converted into a seat organizer, personal items are kept from contacting the sand or ground as the pocket segments are suspended from the seat. In yet another embodiment, the multifunctional organizer is converted into a head rest by simple placing a soft item, such as a towel, sweatshirt or pillow, for example in the center portion of the multifunctional organizer and suspending the pocket portions off the back of the chair. In yet another embodiment the multifunctional organizer may be used as a yoga mat wherein the user may position the organizer in an unfolded form to provide yoga surface while containing their personal items in a pocket portion.

Figure 1:
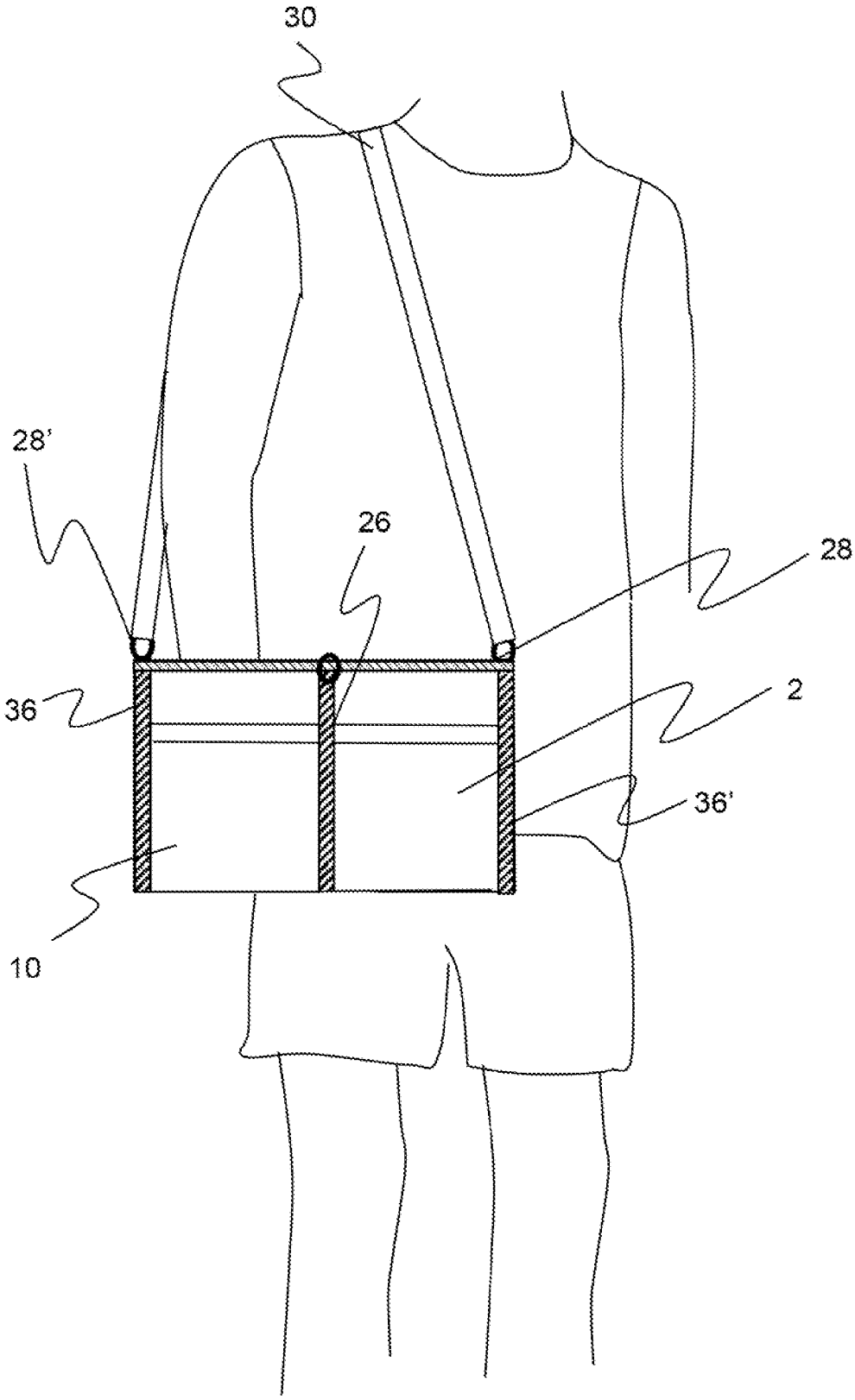
FIG. 1 is an isometric front view of the multifunctional organizer in a carrying tote configuration.
Figure 2:
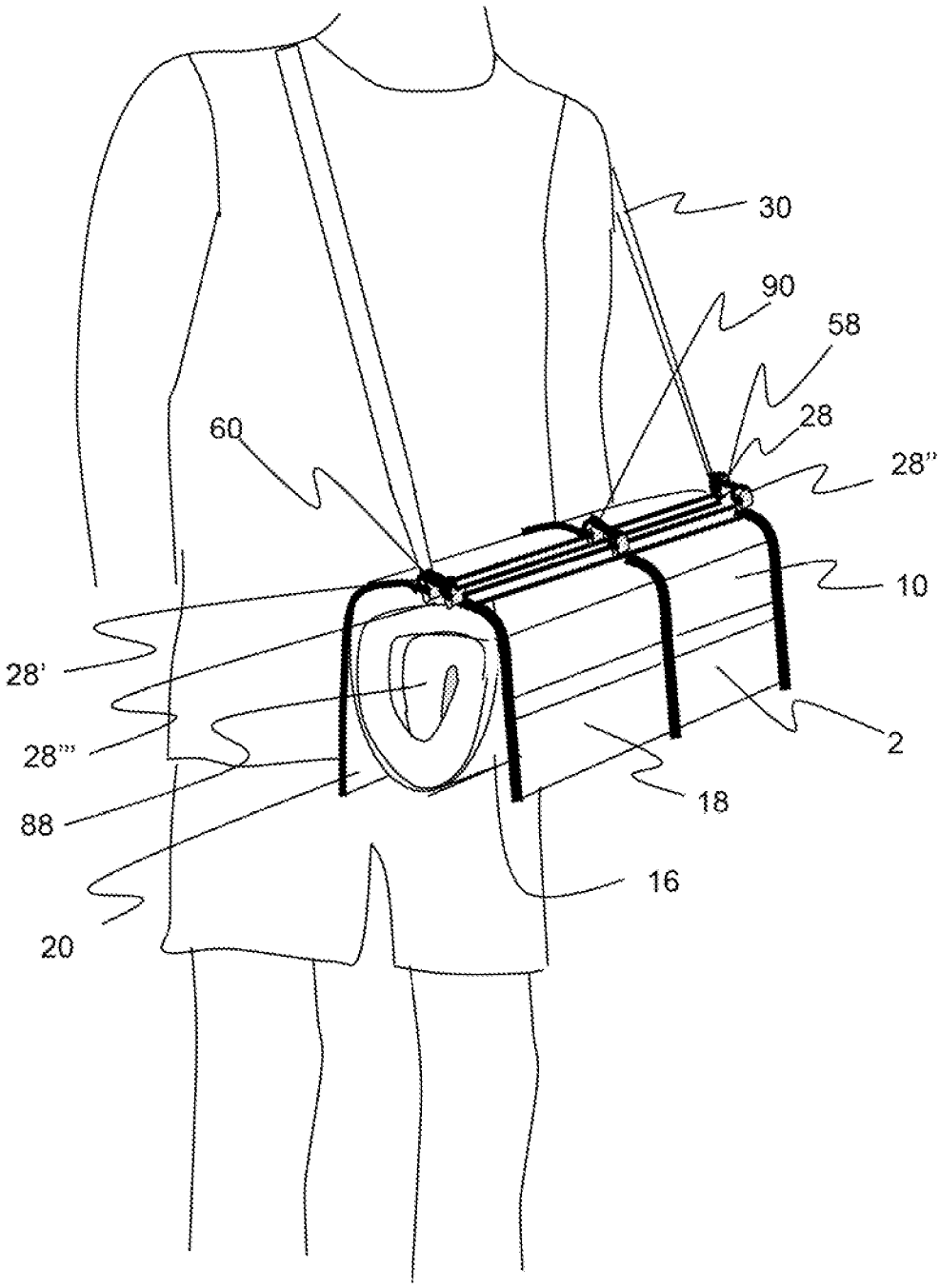
FIG. 2 is an isometric front view of the multifunctional organizer in a carrying tote configuration.
Figure 3:
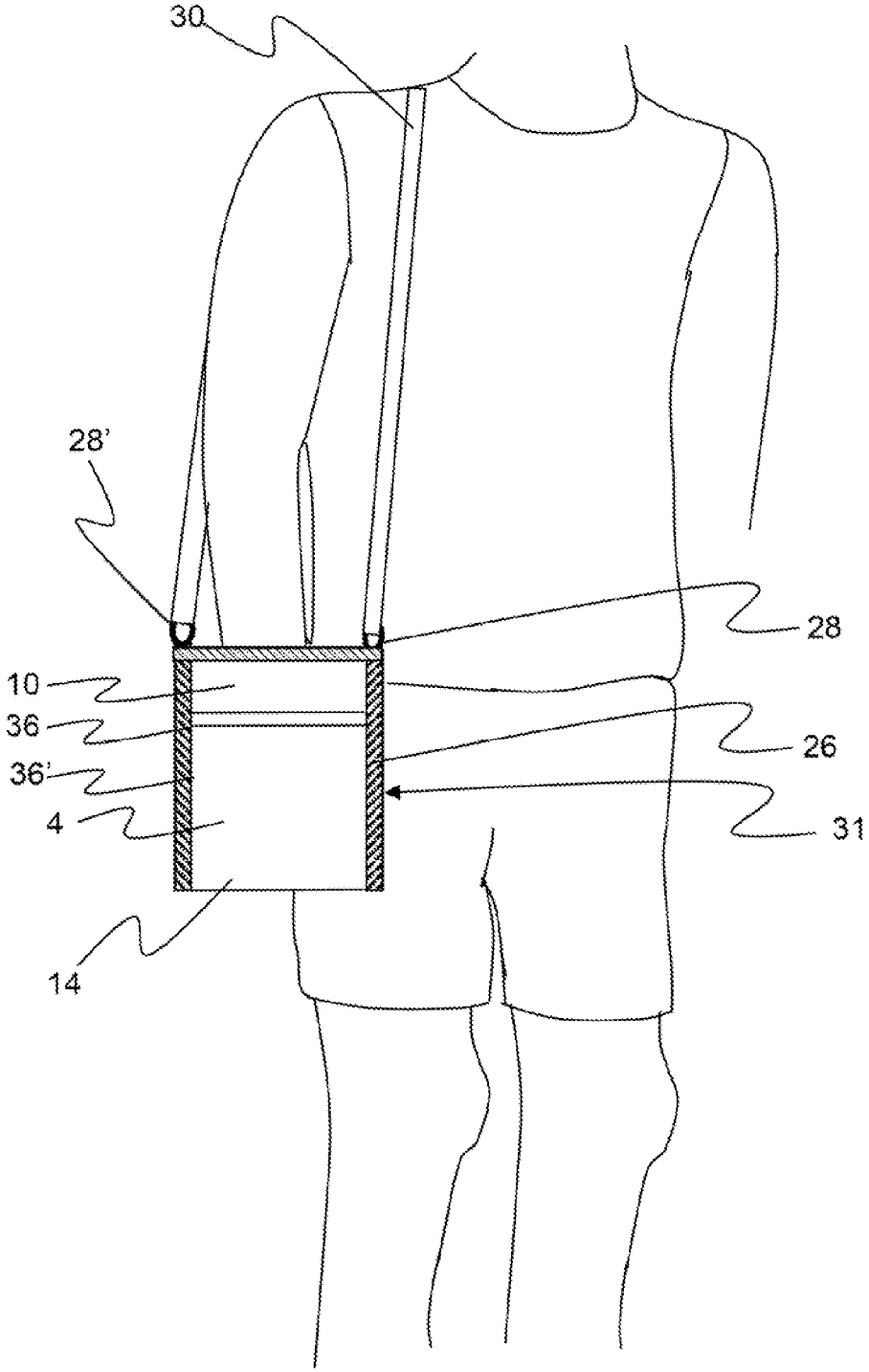
FIG. 3 is an isometric front view of the multifunctional organizer in a purse configuration.
Figure 4:
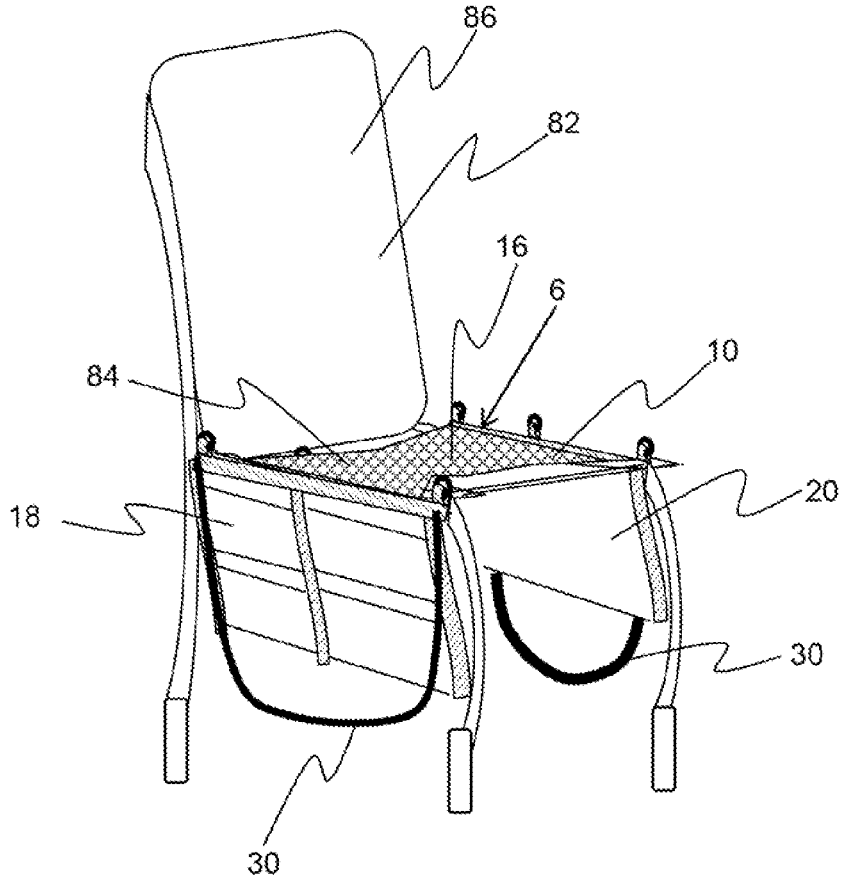
FIG. 4 is an isometric view of the multifunctional organizer in a seat organizer configuration.
Figure 5:
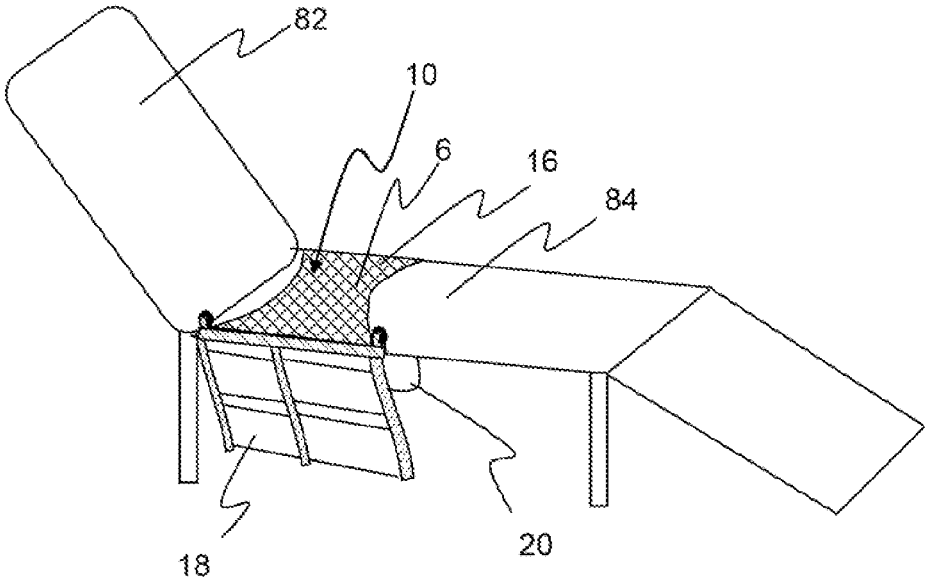
FIG. 5 is an isometric view of the multifunctional organizer in a seat organizer configuration.
Figure 6:
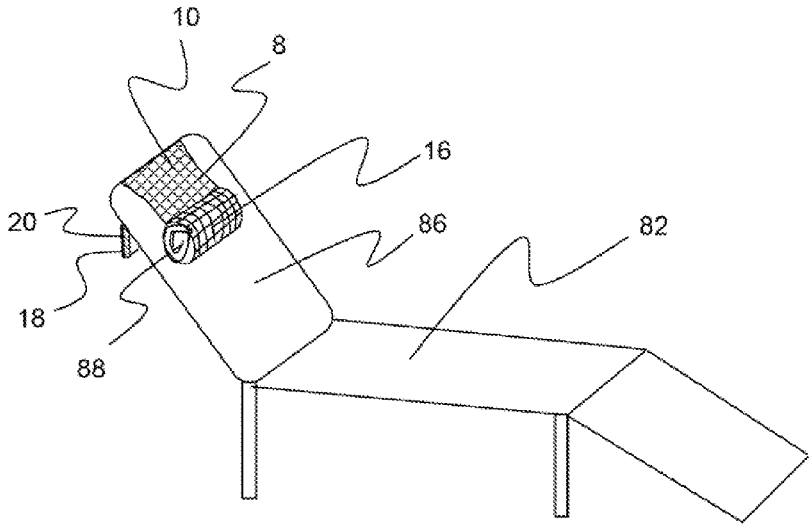
FIG. 6 is an isometric view of the multifunctional organizer in a head rest configuration.

The multifunctional organizer 10 is depicted in FIG. 1 in the form of a carrying tote 2 having the center portion folded in and the strap 30 attached to fasteners 28 and 28'. The multifunctional organizer can be carried over the shoulder by the strap which allows for hands free transport. In FIG. 2, the multifunctional organizer 10 is depicted as a carrying tote 2 with a towel 88 held within the center portion 16 thereby expanding the multifunctional organizer. The multifunctional organizer 10 is depicted in FIG. 3 in the form of a purse 4, having the main body 14 folded at a folding feature 31 to reduce the width of the multifunctional organizer. The multifunctional organizer 10 is depicted in FIG. 4 and FIG. 5 as a seat organizer 6, having the center portion 16 draped across the seat of the chair 82 and the pocket portions 18 and 20, hanging from either side of the seat 84 for convenient storage of personal items. The multifunctional organizer 10 is depicted in FIG. 6 as a head rest 8, wherein a towel 88 has been placed within the center portion 16 and the pocket portions 18 and 20 are draped over the chair back 86. The multifunctional organizer when used in this configuration may actually provide a support or cushion for any part of the body including but not limited to the back or lumbar, leg or knees and the like. The user of the multifunction organizer simply has to locate the center portion containing the soft item in a location where they prefer the support.

Figure 7:
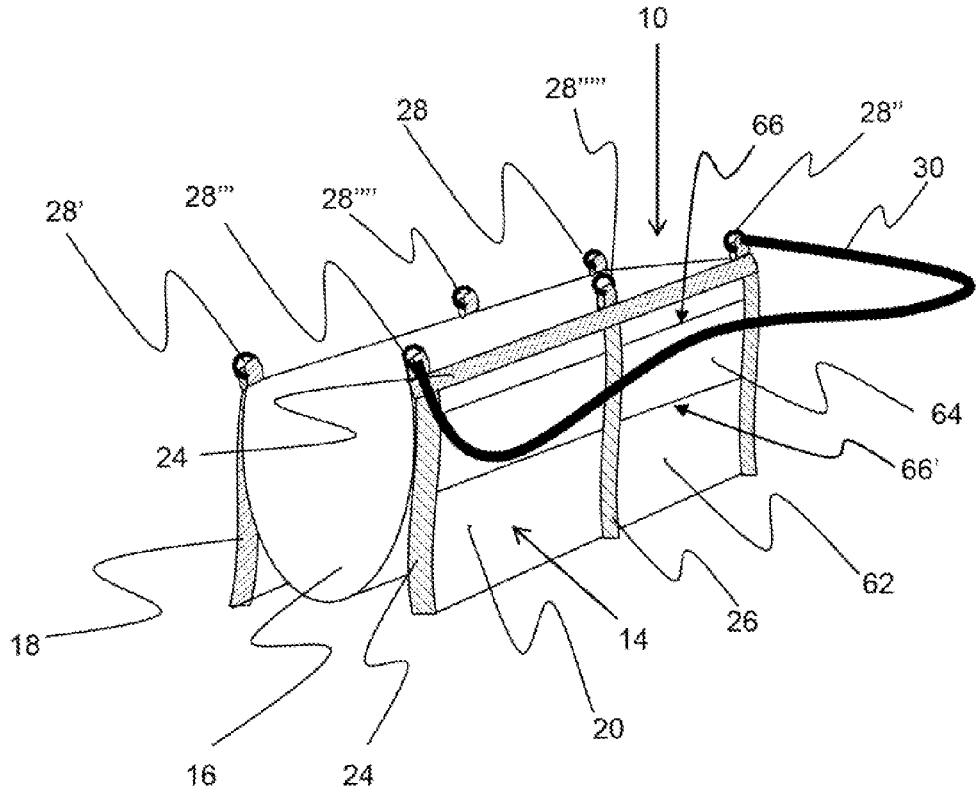
FIG. 7 is an isometric view of the multifunctional organizer in a carrying tote configuration.

The multifunctional organizer is quick and simple to manufacture in part because the main body consists of a single contiguous piece of material, and in one embodiment the material is generally a rectangular shape. The single contiguous piece of material may be folded in an accordion fashion at both ends, and the layers of material produced by these folds are then attached, for example along the edges, to produce the pocket portions of the multifunctional organizer. As depicted in FIG. 7, the multifunctional organizer 10 has a center portion 16, first and second pocket portions 18 and 20, fasteners 28, through 28'''', located between the center portion and the pocket portions, and a strap 30 fastened to at least two of the fasteners. The fasteners may be attached to each other, or a latch or fastener on the strap may be used to connect two or more fasteners together. For example, as shown in FIG. 7, fastener 28''' may be attached to fastener 28', or the strap may attach or fasten these two fasteners together. Likewise any of the fasteners may be attached together to provide versatility in configurations. In one embodiment, a fastener between the center portion and a first pocket portion comprises a ring or loop, and a fastener between the center portion and the second pocket portion comprises a latch that can attach to the ring or loop.

The pocket portions as depicted in FIG. 7 are comprised of multiple pockets of different sizes, wherein a dividing attachment 26 creates two separate pockets across the width of the multifunctional organizer. Furthermore, the accordion folds can produce pockets having different depth, wherein the second pocket 64, is much deeper than the first pocket 62 as depicted in FIG. 7. The first pocket 62 is an outer to pocket having an opening 66'. The first pocket opening 66', and the second pocket opening 66 are located at different locations or lengths along the pocket portion 20 as depicted in FIG. 7.

Figure 12:
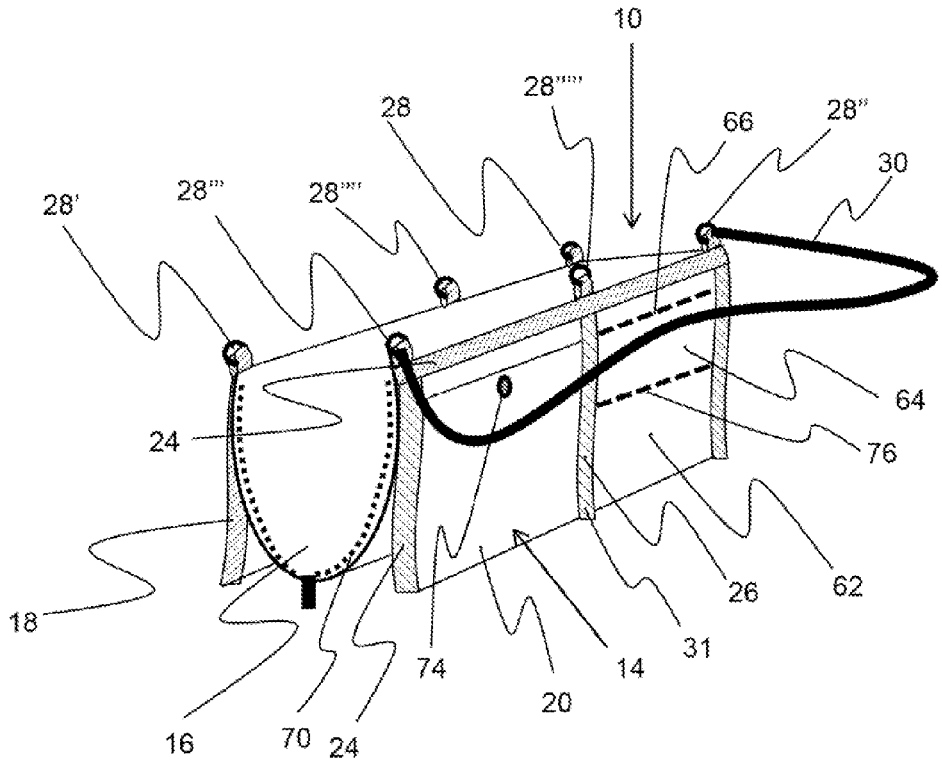
FIG. 12 is an isometric view of a multifunctional organizer having a zipper along the outer edge of the center portion.

In addition, as depicted in FIG. 12, a pocket may have a closure feature such as a button 74 or zipper 76. Furthermore, the center portion may comprise a closure feature on one or both edges such as a zipper 70, hook and loop fastener such as Velcro, buttons, snaps, and the like. The closure feature of the center portion allows for more secure storage of items within the center portion.

Figure 8A:
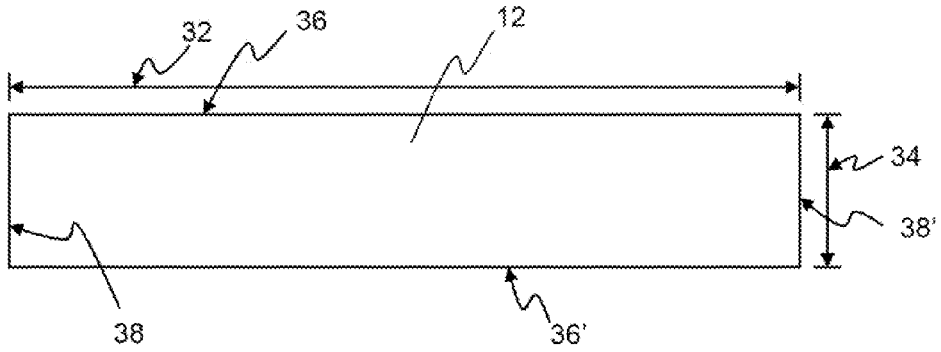
FIG. 8A is a top view of the single contiguous piece of material.

The multifunctional organizer in one embodiment is comprised of a main body consisting of a single contiguous piece of material, having a length 32, pair of opposing longitudinal edges 36, 36' extending the length of the material, and two lateral ends 38, 38' extending the width 34 of the material, as depicted in FIG. 8A. The main body material can be any suitable material such as a fabric, film, mesh, woven or non-woven, comprising natural or synthetic materials. In one embodiment the main body consists of synthetic materials. A preferred material is quick drying, and in one embodiment is a synthetic woven fabric or mesh. The material may be hydrophobic, having less than 10% weight gain when submerged in water for 10 minutes and then removed from the water and shaken to remove any loosely attached water. In addition, the material may be supple to allow the pocket portions to drape over the seat of a chair as seen in FIG. 4 and FIG. 5. The main body material may have any suitable weight, such as but not limited to more than about 20 g/m$^2$, more than about 50 g/m$^2$, more than about 100 g/m$^2$, more than about 300 g/m$^2$, more than about 500 g/m$^2$, no more than about 1000 g/m$^2$, between about 20 g/m$^2$ and 1000 g/m$^2$, or between about 50 g/m$^2$ and 500 g/m$^2$.

The versatility of the multifunctional organizer of the present invention makes it well suited for beach use, and in one embodiment the main body consists of a fabric mesh that allows sand to easily pass there through; thereby preventing sand from collecting in the pockets. In one embodiment the main body is made of a mesh material having open spaces between solid portions, or openings. The openings may be any suitable size and may have a maximum distance across the opening greater than or equal to about 1 mm, greater than about 3 mm, greater than about 5 mm, greater than about 10 mm, or between 1 mm and 10 mm, or between about 3 mm and 10 mm. Mesh as used herein is defined as a material that is characterized by open spaces between solid portions, yarns, or filaments, and may be woven or non-woven material. A mesh may be a woven fabric or an apertured film.

Figure 13A:
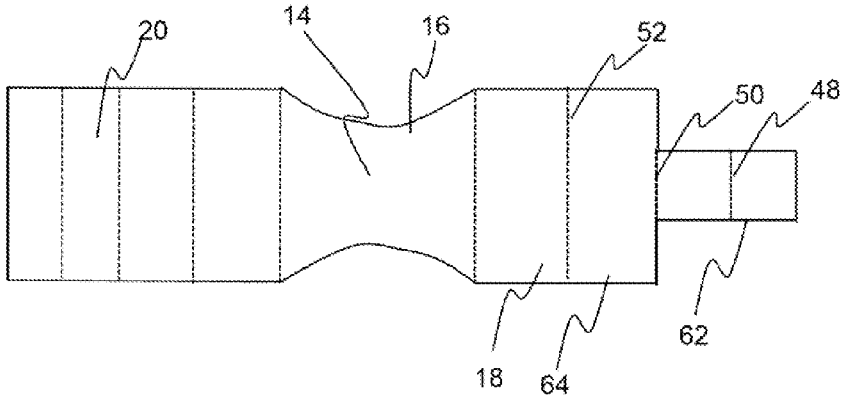
FIG. 13A is a top view of a single contiguous piece of material.

In another embodiment the multifunctional organizer is comprised of a main body consisting of a single contiguous piece of material having a non-rectangular shape as depicted in FIG. 13A, wherein the material is configured to have a first pocket 62 on the first pocket portion 18, being more narrow than the width of the second pocket 64 on the first pocket portion. Accordion folds are depicted as dashed lines in FIG. 13A. In addition, the center portion 16 as depicted in FIG. 13A is configured with curved edges.

Figure 8B:
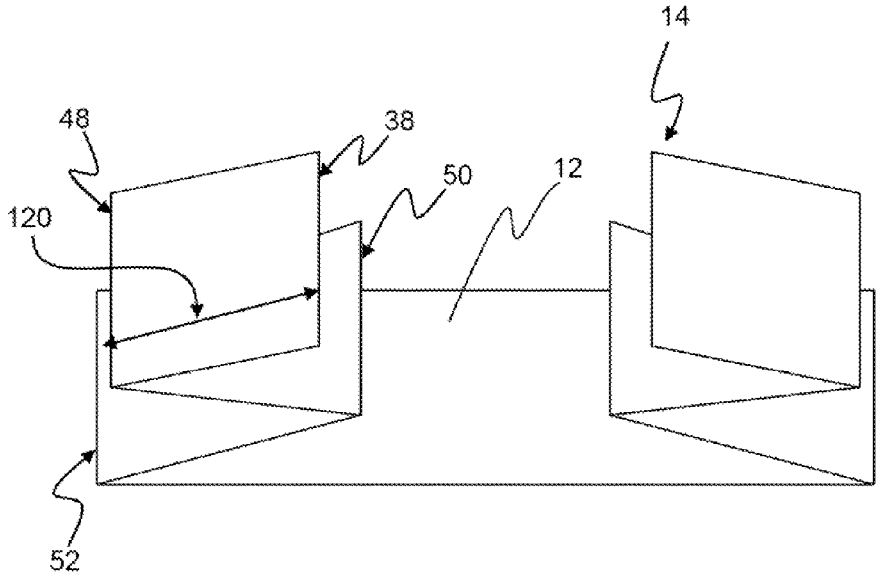
FIG. 8B is an isometric view of the single contiguous piece of material having accordion folds.

The main body of the multifunctional organizer may be easily constructed by folding a single contiguous piece of rectangular shaped material at each end at least three times to produce accordion folds, as depicted in FIG. 8B. The first accordion fold 48 determines the depth or length 120 of the outer or first pocket, and the second accordion fold 50 determines the depth of the inner or second pocket, and the third accordion fold 52 creates the overlap of material needed for the inner pocket. The accordion folds can be produced in a variety of ways to produce any number of pockets having a variety of depths. In one embodiment the accordion folds are created in such a way to produce a first and second pocket having approximately the same depth. In another embodiment the accordion folds are created in such a way to produce a first pocket having a length that is less than the length of a second or inner pocket.

Figure 9A:
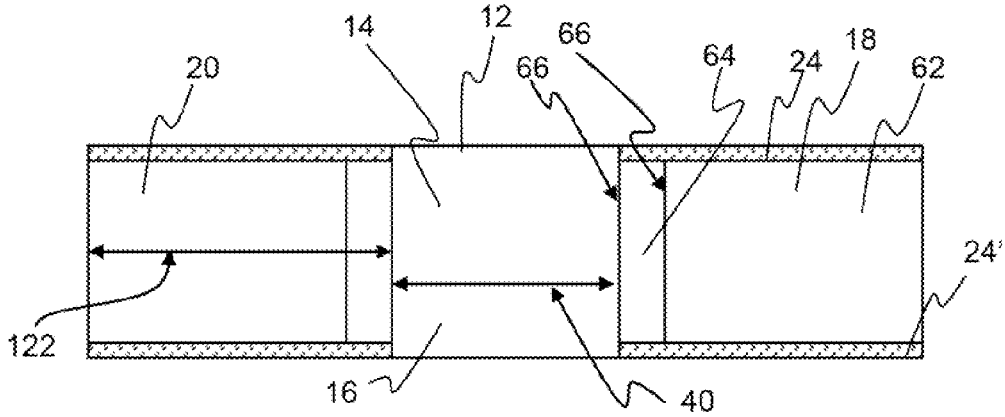
FIG. 9A is a top view of the main body having attachments along the lengths of the pockets portions located along the longitudinal edges.
Figure 9B:
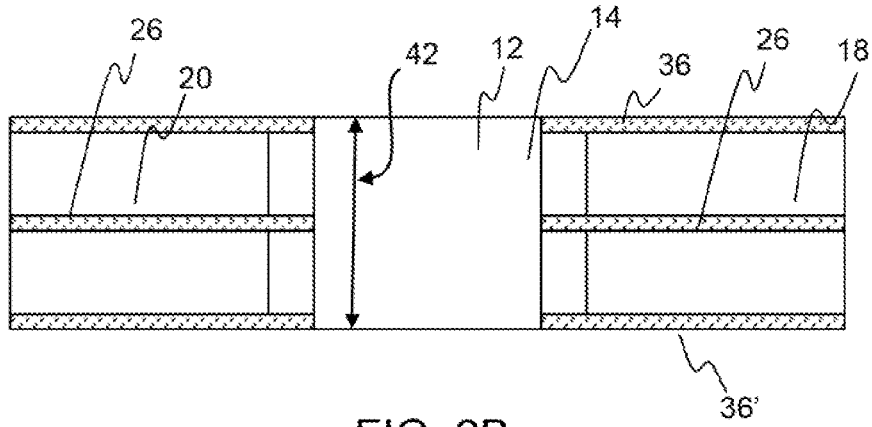
FIG. 9B is a top view of the main body having attachments along the lengths of the pockets portions located along the longitudinal edges and a dividing attachment extending the length of the entire pocket portion between the two longitudinal edges.

The length of the single contiguous piece of material must be selected to provide adequate material to produce the depth of pockets desired and maintain enough length of material for the center portion. In one embodiment, the length of the center portion 40 as depicted in FIG. 9A may be greater than about 20 cm, greater than about 30 cm, greater than about 50 cm, greater than about 75 cm, or between about 20 cm and 75 cm, or between about 30 cm and 50 cm. The width of the center portion 42 as depicted in FIG. 9B may be any suitable width including but not limited to greater than about 10 cm, greater than about 20 cm, greater than about 40 cm, greater than about 75 cm, or between about 10 cm and 75 cm, or between about 20 cm and 40 cm. The length of the pocket portions 122, as shown in FIG. 9A, may be any suitable length including but not limited to greater than about 20 cm, greater than about 30 cm, greater than about 50 cm, greater than about 75 cm, or between about 20 cm and 75 cm, or between about 30 cm and 50 cm. In one embodiment, the length of the center portion is approximately double the length of the pocket portions, therein allowing the center portion to fold in half and be covered by the pocket portions. In a preferred embodiment, the main body 14 of the present invention is formed from the single contiguous piece of material 12 and no pockets or portion of a pocket is formed from the addition of separate piece of material as depicted in FIG. 8B.

After the single contiguous piece of rectangular shaped material is folded, the overlapped material or folds may be attached along at least a portion of the length of the folds. The attachments can be any suitable means to attach the layers of material together and can be continuous such as melted line, adhesive bead or continuous stitch, or may be discontinuous having segments along the length that are attached and segments or gaps that are not attached, such as a discontinuous melted segment, or discontinuous adhesive. The attachment may also comprise additional material to reinforce or provide a decorative element to the multifunctional organizer. In one embodiment, a strip of fabric is sewn along the attachment to reinforce the attached area of the multifunctional organizer.

Figure 9C:
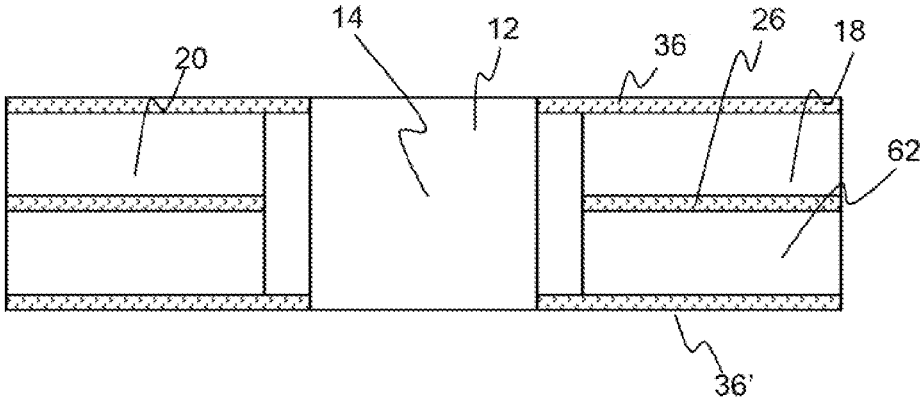
FIG. 9C is a top view of the main body having attachments along the lengths of the pockets portions located along the longitudinal edges and a dividing attachment extending the length of the outer pocket portion between the two longitudinal edges.
Figure 10A:
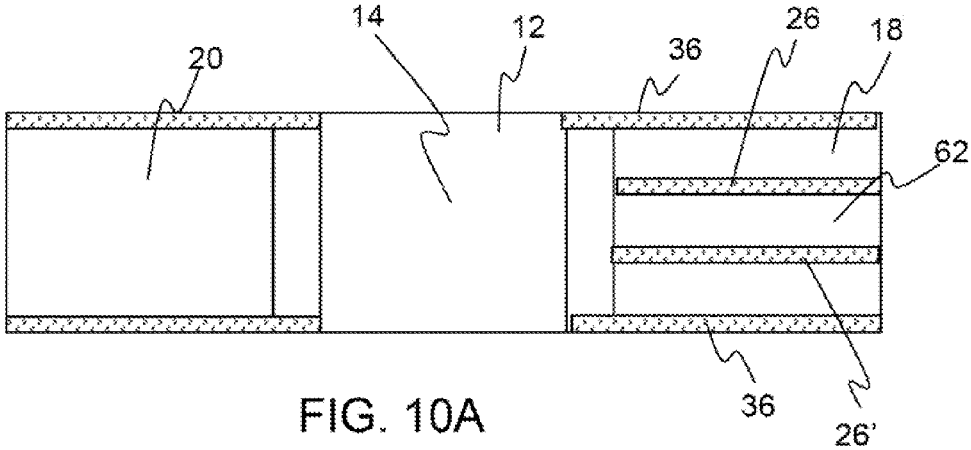
FIG. 10A is a top view of the main body having attachments along the lengths of the pockets portions located along the longitudinal edges and two dividing attachment on the first pocket portion extending the length of the outer pocket portion between the two longitudinal edges.

In one embodiment, as depicted in FIG. 9A, attachments 24, 24' extend along longitudinal edges of the folded sections of the material, to produce a first 62 and second pocket 64 on each pocket portion 18 and 20. The center portion 16, as depicted in FIG. 9A, is the section of material between the first 18 and second pocket portions 20 and has a length 40. In another embodiment, as depicted in FIG. 9B, a dividing attachment 26 extends the length of the first 18 and second pocket portions 20, approximately centered between the two longitudinal edges 36 and 36'. This attachment can be selected to provide a natural fold or break point so that the multifunctional organizer can be easily converted into a purse by folding. In another embodiment, as depicted in FIG. 9C, a dividing attachment 26 extends just along the length of the first pocket 62, thereby creating two outer pockets and one wider inner pocket. In addition, as depicted in FIG. 10A, two dividing attachments 26 and 26' extend the length of the first pocket 62 on only the first pocket portion 18. Any number of different configurations of the pockets, pocket lengths or depths, and number of divisions or attachments can be envisioned. In one embodiment the multifunctional organizer has three pockets formed by accordion fold on at least one pocket portion and in another embodiment the multifunctional organizer has four pockets formed by accordion folds on at least one pocket portion. The multifunctional organizer can have a variety of accordion folds and pockets produced therefrom. In addition, the number of folds and the number of pockets produced may differ from the first pocket portion to the second pocket portion. For example, the first pocket portion may have two pockets and the second pocket portion may have four pockets. In one embodiment, one pocket portion comprises five pockets. At least one pocket portion of the multifunctional organizer may have two, three, four, five, more than five or between two and ten pockets.

Figure 10B:
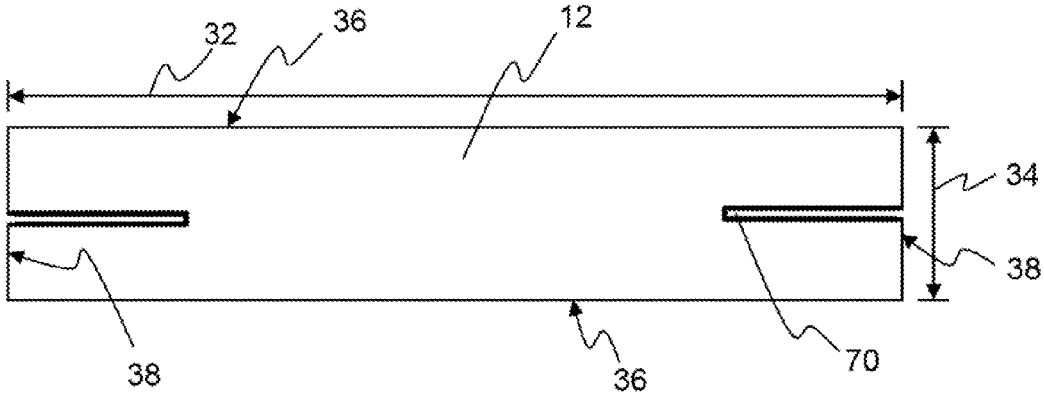
FIG. 10B is a top view of the main body having slit type folding feature.

In one embodiment as depicted in FIG. 10B, the single contiguous piece of material 12 comprises a slit or an area where a narrow section of material is removed 70, which when constructed into the multifunctional organizer, provides a natural location for the tote to fold into the purse configuration.

Figure 10C:
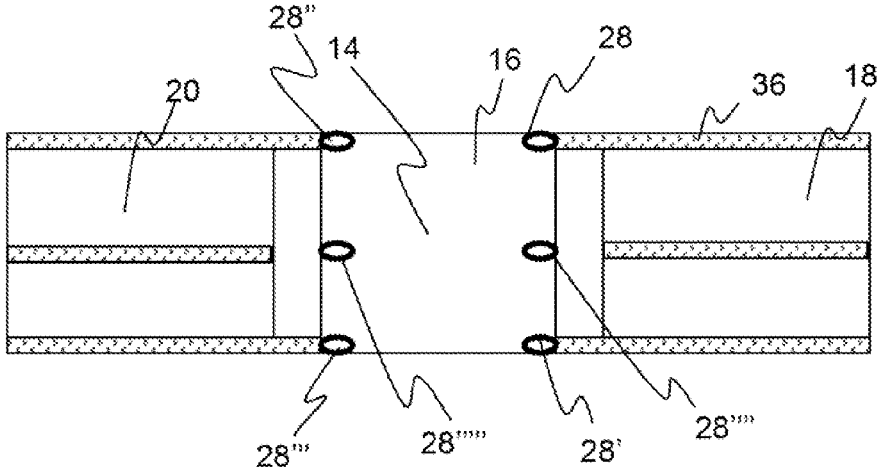
FIG. 10C is a top view of the multifunctional organizer having fasteners attached between the center portion and the two pocket portions.

The fasteners 28, 28', 28'', 28''', 28'''', 28''''' are depicted as being located between each pocket portion 18, 20 and the center portion 16 in FIG. 10C. The arrangement of the fasteners across the width of the multifunctional organizer provides versatility in how the multifunctional organizer can be configured. A strap can be attached to the two fasteners on each longitudinal edge of the material to configure the multifunctional organizer as a carrying tote. The multifunctional organizer may be folded and the strap can be fastened to the fasteners at the outer edges of the folded article to configure the multifunctional organizer as a purse. Any number of fastening arrangement can be envisioned. The fasteners can be any suitable type such as but not limited to a loop, snap, hook and loop material or Velcro, latch, button, hook, or hole, or any combination thereof. In a preferred embodiment, the fastener is a loop, and the strap comprises a latch on either end that can be opened to attach to one of more loops. Additional connectors may be used to connect or attach fasteners, such but not limited to buttons, snaps, Velcro, hooks, or latches, and the like and any combination thereof. In addition, a connector may comprise a strap or strip of material comprising any of the connectors or fasteners described herein. As depicted in FIG. 2, a connector 90 connects the center fasteners between the first pocket portion 18 and second pocket portion 20. In one embodiment, a connector comprises a piece of hook and loop material that may be pulled through a loop, for example, and pressed together to attach the connector.

Figure 13B:
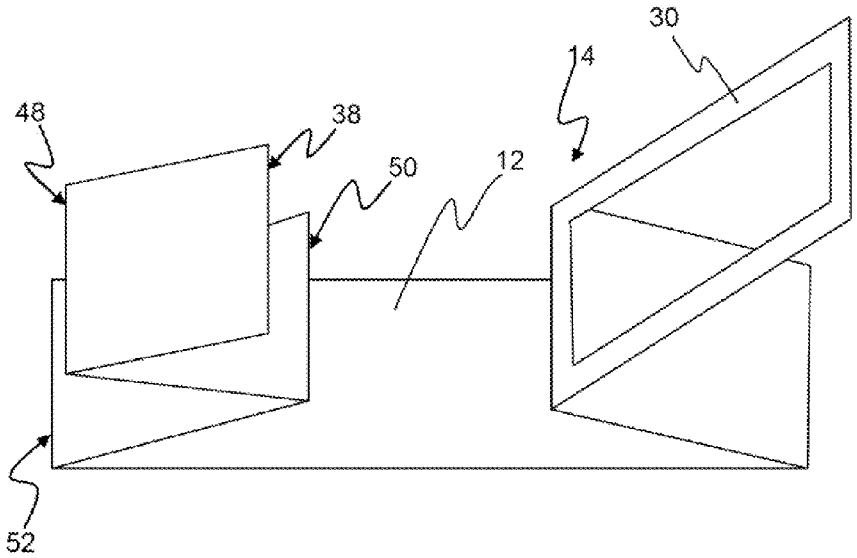
FIG. 13B is an isometric view of a single contiguous piece of material.

In one embodiment as depicted in FIG. 13B, a strap 30 may be an integral part of the single piece of material 12 that forms the main body 14. As shown in FIG. 13B, a strap 30 may be configured from a portion of the main body, wherein a portion of material may be cut out.

Figure 11:
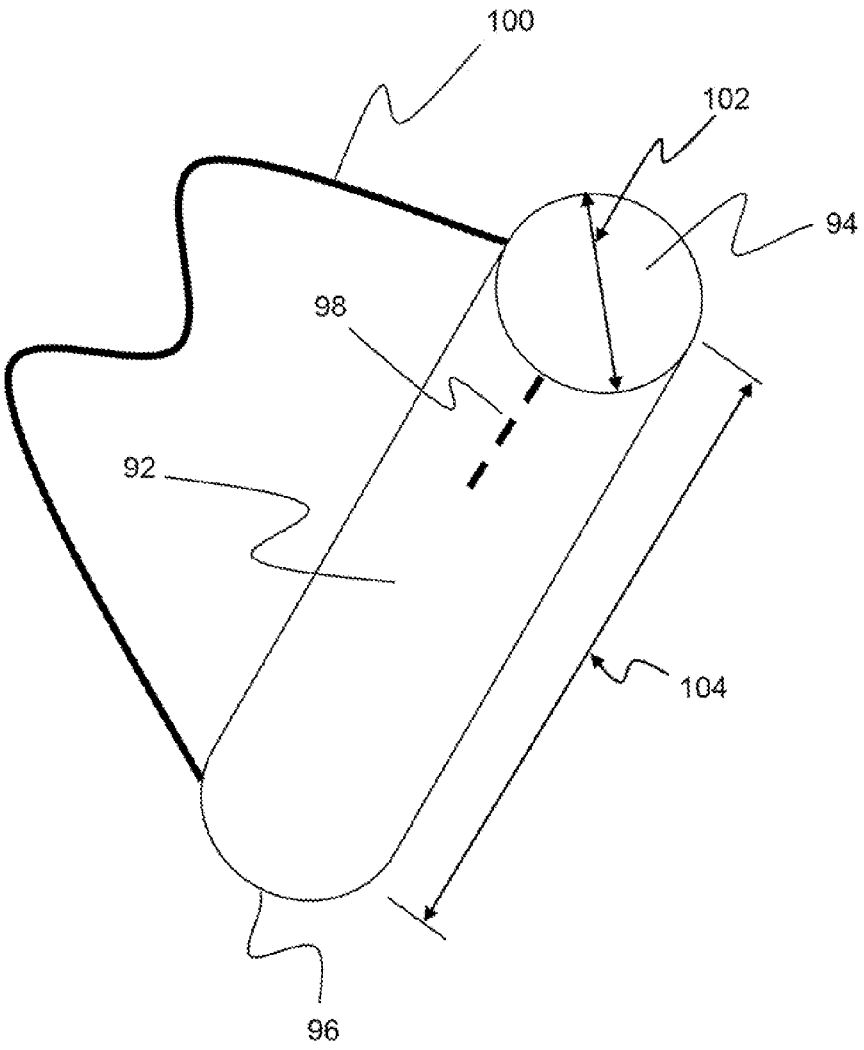
FIG. 11 is an isometric view of a multifunctional organizer in a carrying container.

In one embodiment the multifunctional organizer can be contained within a carrying container such as a sleeve depicted in FIG. 11. The single contiguous piece of material may be selected such that the multifunctional organizer can fit into a small volume such as less than 500 $cm^3$, less than 1,000 $cm^3$, less than 2,000 $cm^3$ less than 4,000 $cm^3$ less than 8,000 $cm^3$, between 500 $cm^3$ and 8,000 $cm^3$ or between 1,000 $cm^3$ and 6,000 $cm^3$. The carrying container 92 may be a sleeve having an open end 94 and a closed end 96 wherein the multifunctional organizer can be placed within the volume of the carrying container and carried with an optional strap 100 as depicted in FIG. 11. The carrying container 92 may have an opening and closure feature such as a zipper 98 extending down at least a portion of the length 104 of the carrying container. When the carrying container is a tubular sleeve, the diameter may be less than about 15 cm, less than about 12.5 cm, less than about 10 cm, less than about 7.5 cm, or less than about 5 cm. When the carrying container is a tubular sleeve the length of the sleeve may be no more than about 25 cm, no more than about 50 cm, or no more than about 75 cm. The carrying container may rigid such as a plastic tube or sleeve, or flexible such as a fabric sleeve.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

DEFINITIONS

Single contiguous piece of material as used herein is defined as a single piece or attached pieces of material to from one single planar sheet of material having no material branching therefrom, and in one embodiment the contiguous piece of material is rectangular shaped having a length and width. In a preferred embodiment, the main body of the article of the present invention is formed from the single contiguous piece of material consisting of one piece or sheet of material as depicted in FIGS. 8A, 8B, 9A through 9C, and 10A through 10C, and no pockets or portion of a pocket is formed from the addition of separate piece of material. As described herein, a separate piece of material may be used to reinforce a pocket attachment, but this is not to be considered a portion of the pocket.

Attachment as used herein in relation to the attachments and dividing attachments of the folded segments of the single contiguous piece of rectangular shaped material is defined as a continuous or discontinuous affixed portion of at least two layers of the material, and may comprise an adhesive or an additional layer of attachment material.

Folding feature as used herein is defined as a design element that provides a natural place for the multifunctional organizer to fold in the width direction to configure it as a purse from a carrying tote and may comprise an edge of an attachment or may comprise the modification or removal of the Main body material such as a cut in the material.

Main body as used herein is defined as the center portion and first and second pocket portions of the multifunctional organizer and consists essentially of a single contiguous piece of material that has been folded at both ends in an accordion fashion.

What is claimed is:

1. A method of using an article that is convertible to a carrying tote, a purse, a eat organizer, and a head rest, said method of using comprising the steps of:

providing a multifunctional organizer comprising;

a main body consisting of a single contiguous piece of rectangular shaped material wherein the main body comprises;

a center portion having a length and width, a first pocket portion having longitudinal edges; and a second pocket portion having longitudinal edges, each of said pocket portion comprising, at least three accordion folds, wherein the pocket portions are formed from folded sections of the main body material;

attachments along said longitudinal edges of the accordion folds of both the first and second pocket portions;

at least three fasteners positioned across the width of the main body between the center portion and both the first pocket portion and the second body portion wherein at least two of said at least three fasteners are located substantially along said longitudinal edges and a third fastener is centrally located across the width of the main body and a strap having comprising:

a length, a first end, having a latch, and a second end, having a latch; and at least one folding feature;

placing personal items into the pockets and carrying the tote with strap configured to form a carrying tote;

folding the article along folding feature across said main body width, whereby said longitudinal edges are configured substantially parallel to each other, and adjusting said strap whereby said latch on said first end of said strap is fastened to the fasteners configured along the longitudinal edges of the folded article and the latch on said second end of said strap is fastened to said third fastener to convert said multifunctional organizer into a purse;

positioning the article over a chair seat, therein providing pockets for convenient storage of personal items, therein converting the article into a seat organizer; and positioning the article over the end of a chair, with center portion enveloping a soft item, with the pocket portions positioned over the end of the chair back, to convert the article into a head rest.

2. The method of claim 1, wherein the at least one folding feature comprises a cut away portion of material.

3. The method of claim 1, wherein the at least one folding feature is configured between the longitudinal edges and extends at least along the length of each pocket portion.

4. The method claim 1, wherein the at least one folding feature is configured approximately in the center of the width of the main body and extends along the length of each pocket portion.

5. The method of claim 1, wherein the multifunctional organizer further comprising a center portion closure feature.

6. The method of claim 1, wherein the main body consists of a synthetic material.

7. The method of claim 1, wherein the main body consists of a mesh material.

8. The method of claim 1, wherein the mesh material comprises openings with a maximum distance across the opening of at least 3.0 mm.

9. The method of claim 1, wherein the center portion has a length of at least 30 cm and a width of at least 20 cm.

10. The method of claim 1, wherein at least one of the pocket portions comprise five accordion folds.

11. The method of claim 1, wherein each pocket portion comprises at least three accordion folds, and wherein the at least one dividing attachment only attaches an outer accordion fold.

12. The method of claim 1, wherein the first and second pocket portions have a length that is approximately equal.

13. The method of claim 1, wherein the at least three fasteners comprise a loop.

* * * * *